United States Patent [19]

DeMoore

[11] Patent Number: 4,691,632

[45] Date of Patent: Sep. 8, 1987

[54] METHOD AND APPARATUS FOR ATTACHING ANTI-SMEAR NET TO PRINTING PRESS TRANSFER CYLINDER

[76] Inventor: Howard W. DeMoore, 10954 Shady Trail, Dallas, Tex. 75220

[21] Appl. No.: 883,035

[22] Filed: Jul. 8, 1986

[51] Int. Cl.[4] ..... B41F 21/00

[52] U.S. Cl. ..... 101/426; 101/419; 101/422; 118/DIG. 15

[58] Field of Search ..... 101/416 R, 418–421, 101/422, 415.1, 382 R, 378, 401.1, 426; 118/DIG. 15

[56] References Cited

U.S. PATENT DOCUMENTS

| | | | |
|---|---|---|---|
| 1,743,258 | 1/1930 | Williams | 101/421 X |
| 2,085,845 | 7/1937 | Binkley | 101/420 |
| 3,126,826 | 3/1964 | Fischer | 101/420 |
| 3,161,130 | 12/1964 | Vogel | 101/422 |
| 3,382,799 | 5/1968 | Luehrs | 101/415.1 |
| 3,727,551 | 4/1973 | Kostas et al. | 101/415.1 |
| 3,791,644 | 2/1974 | DeMoore | 101/422 X |
| 4,402,267 | 9/1983 | DeMoore | 101/419 |

*Primary Examiner*—E. H. Eickholt

*Attorney, Agent, or Firm*—Kelly, Bauersfeld & Lowry

[57] ABSTRACT

A skeleton wheel for a printing press has a pair of reel assemblies, one mounted axially along each of the leading and trailing edges of an opening extending the full axial width of the wheel, and to which the ends of an anti-smear fabric web are attached. Each reel assembly includes an axially extending roller which is non-rotatably mounted to the wheel yet permitted limited axial movement.

20 Claims, 4 Drawing Figures

FIG. 1
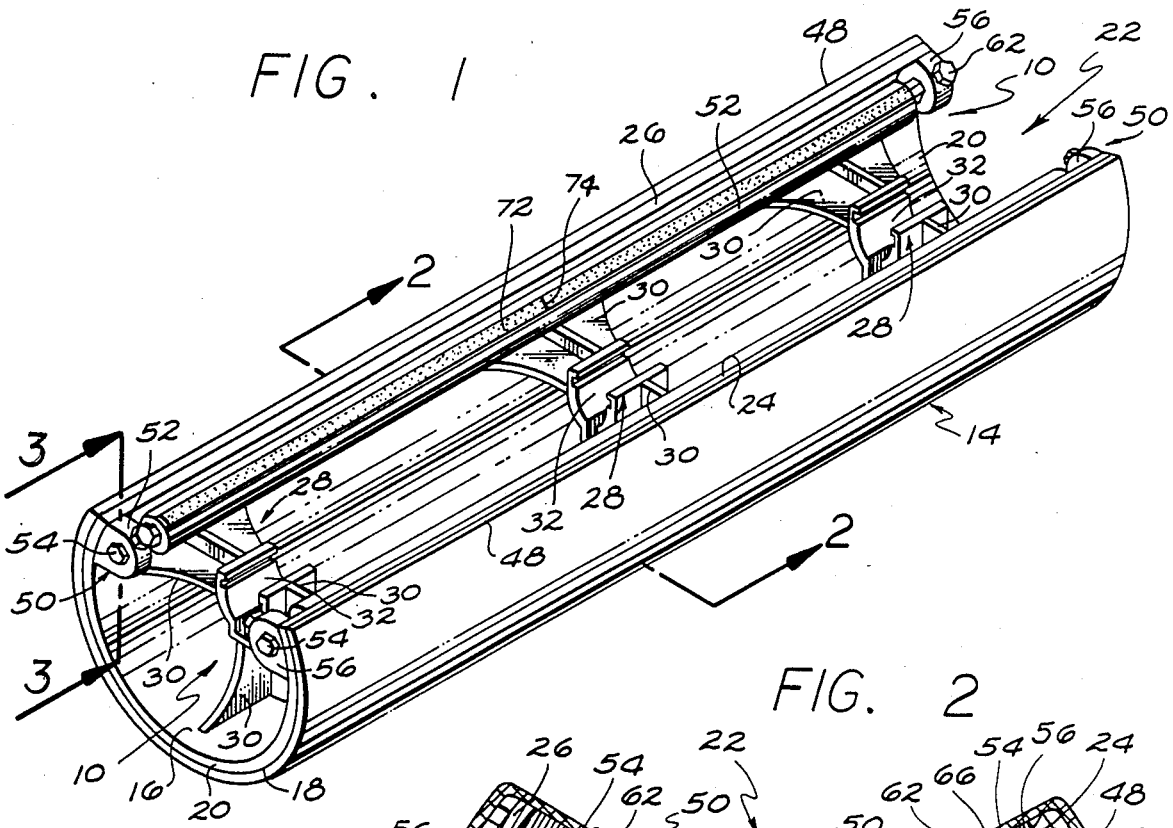
FIG. 2
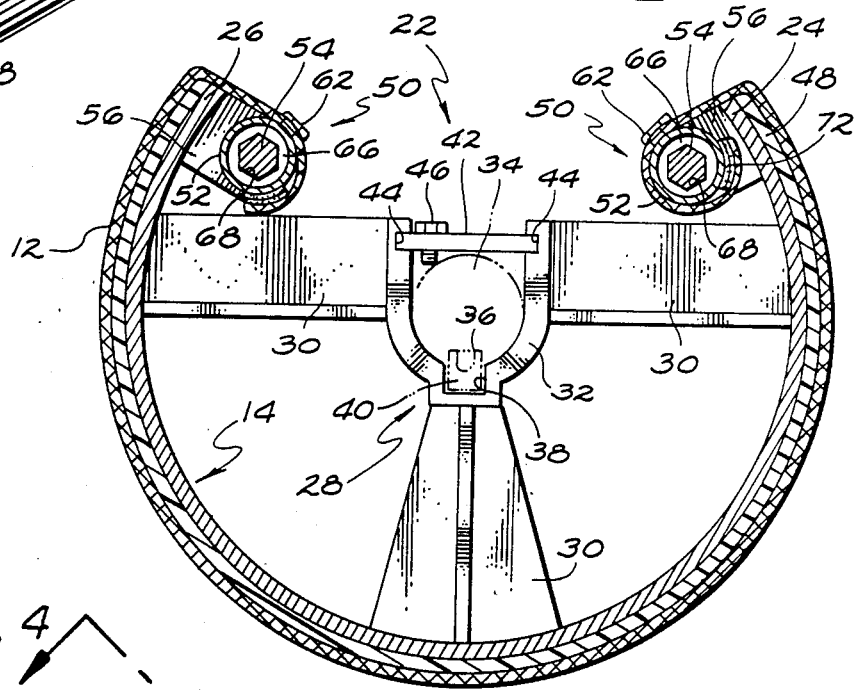
FIG. 3
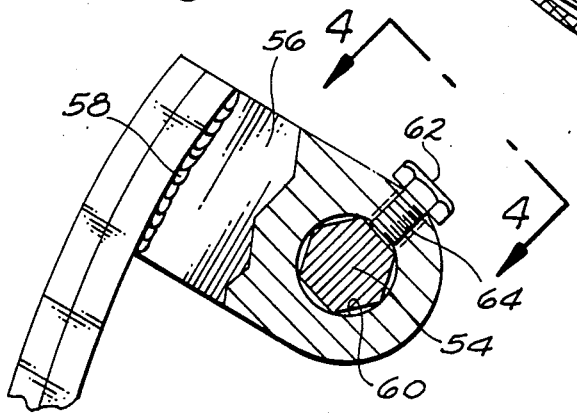
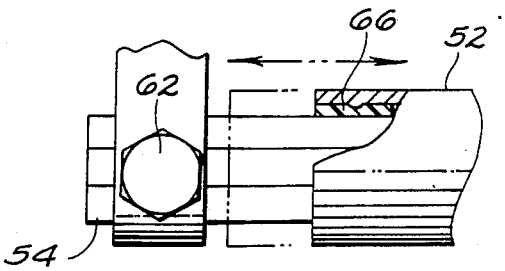
FIG. 4

METHOD AND APPARATUS FOR ATTACHING ANTI-SMEAR NET TO PRINTING PRESS TRANSFER CYLINDER

BACKGROUND OF THE INVENTION

This invention relates to skeleton or transfer wheels of the general type used in high speed, multi-station printing presses, and more specifically to a new and improved method and apparatus for attaching an anti-smear fabric web to such wheels.

To my U.S. Pat. No. 3,791,644 there is disclosed a skeleton wheel for use in a printing press to reduce marking and smearing of the printed surface of a sheet during conveying of the sheet between processing stations in the press. My U.S. Pat. No. 4,402,267 is directed to an improvement of the invention disclosed in my earlier patent, and specifically to a method and apparatus including the attachment of an anti-smear fabric to the support surface of a skeleton wheel.

As disclosed in my U.S. Pat. No. 4,402,267, for proper operation, the anti-smear fabric must be loosely attached to the support surface of the skeleton wheel to permit and accommodate slight relative movement between the fabric covering and the wheel support surface when the printed sheet is supported and transferred by the wheel. As also disclosed in that patent, the fabric covering is attached to the skeleton wheel by fastening strips, such as double sided adhesive strips or fastening strips made under the trademark VELCRO, extending along the axial width of the wheel and disposed along in-turned flanges formed at the leading and trailing edges of the cylindrical supporting wheel surface.

While the method and apparatus disclosed in my aforementioned U.S. Pat. No. 4,402,267 has been highly successful in use, it has been found that some printed sheet marking and smearing may occur in the immediate area of the leading and trailing edges of the wheel support surface, and particularly in the area of the leading edge. It has now been determined that such marking and smearing is caused principally by the manner in which the axial ends of the fabric are fastened to the wheel.

With the use of fastening strips formed on in-turned flanges, as disclosed in my U.S. Pat. No. 4,402,267, the fabric extends over the leading and trailing edges of the wheel support surface in a generally taught condition, thereby restricting relative movement of the fabric in the area of the leading and trailing edges. Due to this taught condition, marking and marring of freshly printed sheets has occurred.

The present invention solves the problem of marking and marring freshly printed sheets in the area of the leading and trailing edges of the wheel support surface by providing a new and improved method and apparatus for attaching the fabric to the wheel.

SUMMARY OF THE INVENTION

The present invention provides a method and an apparatus which permits an anti-smear fabric web to be readily and easily removed, installed and adjusted for proper tension over the support surface of a skeleton wheel of the types used to support and convey printed sheets between processing stations in a high-speed, multi-station printing press. The apparatus of the invention provides a relatively trouble-free and quickly used means for attaching the web to the wheel, and is relatively inexpensive to manufacture and simple in design yet highly effective in use.

The fabric web is attached at each end to a pair of substantially identical reel assemblies, one disposed adjacent the leading edge of the wheel support surface and the other adjacent the trailing edge. Each reel assembly includes a roller to which the web is attached and which is coupled to the wheel to permit limited axial movement of the roller relative to the wheel during operation of the press. In this manner, the web is permitted to move in the area of the leading and trailing edge of the wheel thereby to reduce sheet marking and smearing in the areas of the leading and trailing edges.

Each reel assembly includes a pair of support brackets disposed adjacent the sides of the wheel and which releasably support a rod extending axially between the supports. The roller is non-rotatably but slidably coupled to the rod, and is formed to have an axial length slightly less than the length of the rod between the brackets to permit axial movement of the roller along the rod between the limits of the brackets. Means are provided to permit the rod to be selectively rotated within the brackets, and to attach the ends of the fabric web to the roller.

To attach the web to the wheel, one axial end of the web, preferably the leading axial edge end, is attached to the roller of the reel assembly adjacent the leading edge of the wheel. The trailing axial end of the web is then extended over the wheel support surface and attached to the roller of the reel assembly adjacent the trailing edge of the wheel. The rods are then released for rotation from their support brackets and rotated to wind the fabric onto the roller until the proper web tension is achieved. Thereafter, the rods are resecured to their brackets to clamp the rods and rollers against rotation thereby maintaining the proper web tension over the wheel support surface.

Other features and advantages of the present invention will become apparent from the folloing more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of a skeleton wheel embodying my invention;

FIG. 2 is an enlarged cross-sectional view thereto taken along the line 2—2 of FIG. 1, showing a fabric web attached to the skeleton wheel, and illustrating, in broken line the wheel attached to a shaft of a printing press;

FIG. 3 is an enlarged fragmentary side view, partly in cross-section, of the wheel of FIG. 1 and as seen in the direction of the arrows 3—3 of FIG. 1; and FIG. 4 is a reduced fragmentary plan view, partly in cross-section, as seen in the direction of the arrows 4—4 of FIG. 3.

DETAILED DESCRIPTION OF THE PREFERRED EMBODIMENT

As shown in the exemplary drawings, the present invention is embodied in a new and improved method and apparatus 10 for attaching an anti-smear fabric net or web 12 (see FIG. 2) to a skeleton wheel 14 of the type used to support and convey printed sheets between processing stations in high speed, multi-station printing presses. In this instance, the skeleton wheel 14 is of the general type disclosed in my U.S. Pat. No. 3,791,644, and includes an inner, generally cylindrical wall 16 and an outer generally cylindrical support surface 18 extending between axially spaced sides 20, and an opening 22 extending along the axial width of the wheel so that the inner wall and outer cylindrical support surface extend less than 360 degrees about the wheel axis. The opening 22 is provided to facilitate operation of gripper apparatus (not shown) normally positioned adjacent the skeleton wheel 14 in a printing press, and defines a leading axial edge 24 and a trailing axial edge 26 of the outer cylindrical support surface 18.

To support the skeleton wheel 14 in a printing press, shaft attachment brackets 28 project radially inwardly from the inner cylindrical wall 16, there being three such brackets herein provided in spaced relation along the axial width of the wheel with each bracket being substantially identical to the other. In this instance, each shaft bracket 28 includes three similar struts 30 projecting radially inwardly from the inner wall 16 and terminating in a U-shaped mount 32 which is dimensioned to receive a shaft 34 (shown in broken line section in FIG. 2) suitably journaled for rotation in the press.

Mating key-ways 36 and 38 are formed, respectively, in the shaft 34 and closed end portion of the mount 32 and into which a key 40 is placed to lock the wheel 14 on the shaft against relative rotation. To hold the shaft 34 in position in the bracket, a plate 42 is supported in grooves 44 formed in the bracket adjacent the open end of the bracket to overlie the shaft, and a bolt 46 is threaded through the plate to engage the shaft and securely, but releaseably wedge the shaft in position in the bracket.

As seen in FIG. 2, the outer cylindrical wall 18 is provided with a suitable coating 48 which may be of the type disclosed in my aforementioned U.S. Pat. No. 3,791,644, or may beof the type described in my U.S. Pat. No. 4,402,267. The structure of the skeleton wheel 14 thus far described is generally similar to the skeleton wheels described in my aforementioned U.S. Pat. Nos. 3,791,644, and 4,402,267, and attention is directed to those patents for further details concerning the operation of the skeleton wheel or cylinder in a printing press.

The fabric web 12 is disposed over the coating 48 to extend substantially the full axial width of the wheel 14, as well as from leading edge 24 to the trailing edge 26, and is preferably of the type disclosed in my aforementioned U.S. Pat. No. 4,402,267. While the fabric web 12 as described in my aforementioned U.S. Pat. No. 4,402,267 successfully prevents smearing or marking of a printed sheet, the fabric web does become soiled after prolonged use and must be either periodically replaced or cleaned. Moreover, it may be necessary to periodically adjust the tension in the fabric web 12 to insure proper operation as the fabric web must remain relatively loosely disposed over the outer cylindrical surface 18 to permit slight web movement during use.

In accordance with the present invention, the method and apparatus 10 permit the fabric web 12 to be readily and easily removed, installed, and adjusted for proper tension over the outer cylindrical surface 18 of the wheel 14, and operates in a reliable manner to provide a relatively trouble free and quickly used means for attaching the web to the wheel. Moreover, the apparatus 10 of the present invention is relatively inexpensive to manufacture and simple in design yet highly effective in use.

Toward the foregoing ends, the axial ends of the fabric web 12 are attached to a pair of substantially identical reel assemblies 50 constituting the apparatus 10 of the present invention, with one reel assembly being disposed to extend along the axial width of the wheel 14 adjacent the leading edge 24, and the other extending along the axial width the wheel adjacent the trailing edge 26. Each reel assembly 50 includes a cylindrical roller 52 to which the axial end of the fabric web 12 is attached, and which is coupled to the wheel 14 in such a manner that limited axial movement of the roller is permitted during operation of the wheel in the press, thereby to permit the fabric web to move slightly in the area of the leading and trailing edges 24 and 26 of the cylindrical support surface 18.

More specifically, each roller 52 is slidably mounted on a central axial rod 54 between a pair of spaced support brackets 56 disposed adjacent the sides 20 of the wheel 14 and which are secured by any suitable means, herein by welds 58 (see FIG. 3), to project generally radially inwardly from the inner cylindrical wall 16. Each support bracket 56 has an axially directed bore 60 of circular cross-section through which the end of the rod 54 extends, and is provided with an adjustable bolt 62 threaded through a cooperatively threaded hole 64 formed in the bracket to project into the bore and engage the rod.

To slidably mount each roller 52 to its rod 54, yet prevent rotation of the roller relative to the rod, the rod herein has a hexagonal cross-section and extends through a pair of end plugs 66, herein formed of plastic, having corresponding hexagonal shaped central openings 68, and which are attached, herein by dimples 70 (see FIG. 4), within each of the ends of the roller. The axial width of each roller 52 is dimensioned to be slightly less, preferably on the order of one quarter to one and one-half inches, depending on the size of the press, than the axial distance between the support brackets 56 so that when the rod is secured in position in the brackets, the roller is free to slide axially along the rod within the limits of the brackets.

To mount the axial end of the fabric web 12 to each roller 52, a suitable fastening means 72, such as a double sided adhesive strip or a fastening strip of the type made under the trademark VELCRO, is provided along the length of the roller. Preferably, the fastening means 72 is provided with a center-line mark 74 midway between the axial ends of the roller 52 to form a reference mark for quick attachment of the fabric web 12 to the roller, the web preferably also having a center-line mark formed on each axial edge between the sides.

To install the fabric web 12 on the roller 52, the adjustable bolts 62 of each bracket 56 are threaded out of engagement with the rods 54, thereby freeing the rods for rotation within the bores. One axial end, preferably the leading edge end, of the fabric web 12 is then aligned so that the midpoint of its axial width coincides with the center-line mark 74 of the fastening means 72 and then is pressed downwardly along the fastening means whereby the web is attached to the fastening means of its roller 52. The other axial end of the web 12 is then directed around the outer cylinder support surface 18 of the wheel 14 and fastened to the fastening means 72 of the other roller 52 by similarly aligning the axial width midpoint of the web with the corresponding center-line mark 74 of the fastening means and pressing the web into place.

Thereafter, the rod 54 and roller 52 of each reel assembly 50 is rotated in its brackets 56 until the proper tension of the fabric web 12 over the outer support surface 18 of the wheel 14 is obtained. The adjustable bolts 62 are then threaded into engagement with the rods 54, thereby locking the reel assemblies 50 against rotation. This then maintains the proper tension in the fabric web 12 during operation of the press, yet, since the roller are slidably mounted on the rods 54, permits limited axial movement of the web, particularly in the areas of the leading and trailing edges 24 and 26 of the wheel 14.

Should it become necessary to adjust the tension of the web 12 during use, all that needs be done is to stop the press, release the rod 54 of one of the reel assemblies 50 by unthreading the adjustable bolts 62, and then rotating the rod and its roller 52 until the proper tension has been obtained. The adjustable bolts 62 may then be rethreaded into engagement with the rod 54 and the press restarted for continued operation.

From the foregoing, it should be apparent that the apparatus 10 of the present invention permits a fabric web 12 to be readily and easily removed, installed, and adjusted for proper tension over the support surface 18 of a skeleton wheel 14, and provides a means for permitting limited movement of the fabric web in the immediate areas of the body and trailing edges, 24 and 26, respectively, of the wheel thereby to reduce sheet marking in these areas during use.

A variety of modifications and improvements to the invention described herein are believed to be apparent to one skilled in the art. Accordingly, no limitation on the invention is intended, except by way of the appended claims.

What is claimed is:

1. A method for attaching an anti-smear fabric web having leading and trailing axial ends to the support surface of a skeleton wheel of the type used in supporting and conveying printed sheets in a printing press and having an opening along the axial width defining a leading edge and a trailing edge of the support surface, the steps of:

providing a reel assembly capable of limited axial movement within the opening adjacent the leading edge of the support surface;

attaching the leading axial end of the web to the reel assembly for limited axial movement therewith; and extending the trailing axial end of the web around the support surface and attaching the trailing axial end to the wheel within the opening.

2. The method of claim 1 further including providing a second reel assembly within said opening adjacent said trailing edge of said support surface, and attaching said trailing axial end to said second reel assembly.

3. A method for attaching an anti-smear fabric web having leading and trailing axial ends to the support surface of a skeleton wheel of the type used in supporting and conveying printed sheets in a printing press and having an opening along the axial width defining a leading edge and a trailing edge of the support surface, the steps of:

providing a first reel assembly capable of limited axial movement within the opening adjacent the leading adge of the support surface of the wheel;

providing a second reel assembly capable of limited axial movement within the opening adjacent the trailing edge of the support surface;

providing fastening means on each of said first and second reel assemblies;

attaching one of said leading and trailing axial ends of said fabric to said fastening means of one of said first and second reel assemblies such that said attached end is movable with said reel assembly;

extending the other of said leading and trailing axial ends over the support surface; and attaching the other of said leading and trailing axial ends to said fastening means of the other of said first and second reel assemblies such that said other attached end is movable with said other reel assembly.

4. The method of claim 3 further including the step of adjusting the tension in said web by reeling said one of said leading and trailing axial ends onto said one of said first and second reel assemblies after attachment of said other of said leading and trailing axial ends to said other of said first and second reel assemblies.

5. The method of claim 3 further including the step of adjusting the tension in said web by reeling said other of said leading and trailing axial ends onto said other of said first and second reel assemblies after attachment thereof to said fastening means.

6. The method of claim 3 further including the step of adjusting the tension in said fabric web by simultaneously reeling said one of said leading and trailing axial ends onto said one of said first and second reel assemblies, and said other of said leading and trailing axial ends onto said other of said first and second reel assemblies.

7. A reel assembly for use in attaching an axial end of an anti-smear fabric web along the axial width of a skeleton wheel of the type used in supporting and conveying printed sheets in a printing press and having an opening along the axial width defining a leading and trailing edge, said reel assembly comprising:

a pair of axially spaced support brackets disposed within the opening and attached to said leading edge of said wheel to project generally radially inwardly adjacent the sides of said wheel;

an axially directed bore formed through each of said brackets;

a rod extending between said brackets and through each of said bores;

a roller nonrotatably mounted on said rod for movement axially therealong, said roller having an axial width less than the axial distance between said brackets; and fastening means coupled to said roller for attaching the axial end of said fabric web to said roller.

8. A reel assembly as set forth in claim 7 further including means for releasably securing said rod within each of said bores to prevent rotation of said rod within said bores.

9. A reel assembly as set forth in claim 8 wherein said rod has a hexagonal cross-section and said bores each have a generally circular cross-section.

10. A reel assembly as set forth in claim 8 wherein said releasable securing means comprises a bolt threaded through each of said brackets and projecting into said bores for engagement with said rod.

11. In a skeleton wheel of the type used in supporting and conveying printed sheets between processing stations in a printing press and having an opening along the axial width defining a leading and a trailing edge, the improvement comprising:

a pair of reel assemblies disposed within the opening and extending substantially the full axial width of the wheel, one of said reel assemblies being located adjacent the leading edge of the wheel and the other along the trailing edge thereof, each of said reel assemblies including:

a pair of spaced support brackets attached to the wheel and projecting generally radially inwardly therefrom adjacent opposite sides of the wheel, an axially directed bore of generally circular cross-section extending through each of said brackets, a rod extending between said brackets and through said bores, a roller non-rotatably mounted on said rod for movement axially therealong, said roller having an axial width less than the axial distance between said brackets whereby said roller can move axially along said rod between the limits of said brackets, and means for releasably holding said rod within said bores and preventing relative rotation of said rod within said bores.

12. The improvement as set forth in claim 11 further including fastening means coupled to said roller for attaching a fabric web thereto.

13. The improvement as set forth in claim 11 wherein said releasable means comprises a bolt threaded through each of said brackets into said bores.

14. The improvement as set forth in claim 13 wherein said rod has a polygonal cross-section.

15. The improvement as set forth in claim 14 wherein said roller has a generally cylindrical outer surface and is mounted on said rod by a pan of plastic end caps secured to said roller and having polygonal opening through which said rod projects.

16. In a skeleton wheel of the type used in conveying a printed sheet having wet ink on one side thereof between successive processing stations in a printing press, the wheel having a generally cylindrical peripheral support surface of substantial axial width for supporting the printed sheet, and an opening extending the axial width of the cylinder so that the support surface extends less than 360 degrees, the axial sides of the opening forming leading and trailing edges of the support surface, and a fabric web attached to the cylinder and extending in overlying relation with the support surface between the leading and trailing edges, the improvement comprising:

means coupled with said cylinder and disposed within said opening for attaching at least one axial end of said web to said cylinder, said means being coupled with said cylinder for limited axial movement relative to said cylinder whereby said axial end of said web can move with said attaching means axially relative to said cylinder during operation of said wheel.

17. The improvement as set forth in claim 16 wherein said attaching means comprises:

a rod extending the full axial width of said opening;

means adjacent opposite axial ends of said opening for attaching said rod to said cylinder; and a roller non-rotatably mounted on said rod, said roller having an axial length less than the axial length of said rod and mounted to said rod for limited axial movement along said rod.

18. The improvement as set forth in claim 17 wherein said means for attaching said rod to said cylinder comprises a pair of axially spaced support brackets having axially directed bores formed therethrough, said rod projecting through said bores.

19. The improvement as set forth in claim 18 further including means for releasably securing said rod within each of said bores to prevent rotation of said rod within said bores.

20. The improvement as set forth in claim 19 wherein said releasable securing means comprises a bolt threaded through each of said brackets and projecting into said bores for engagement with said rod.

* * * * *